US010330326B2

(12) United States Patent
Cadima

(10) Patent No.: US 10,330,326 B2
(45) Date of Patent: Jun. 25, 2019

(54) GAS BURNER ASSEMBLY FOR A COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 218 days.

(21) Appl. No.: 15/356,710

(22) Filed: Nov. 21, 2016

(65) Prior Publication Data

US 2018/0142898 A1 May 24, 2018

(51) Int. Cl.

| | |
|---|---|
| ***F24C 3/00*** | (2006.01) |
| ***F24C 15/10*** | (2006.01) |
| ***F24C 3/08*** | (2006.01) |

(52) U.S. Cl.

CPC ..... *F24C 15/107* (2013.01); *F24C 3/085* (2013.01)

(58) Field of Classification Search

CPC ..... F24C 15/107; F24C 3/085
USPC ..... 126/39 E, 39 R, 39 H, 39 K
See application file for complete search history.

(56) References Cited

U.S. PATENT DOCUMENTS

| | | | | |
|---|---|---|---|---|
| 8,616,193 | B2 | 12/2013 | Padgett | |
| 8,899,972 | B2 * | 12/2014 | Fowler | F23D 14/06 126/39 E |
| 9,127,838 | B2 | 9/2015 | Paesani et al. | |
| 2010/0005976 | A1 | 1/2010 | Inzaghi | |
| 2010/0089384 | A1 * | 4/2010 | Inzaghi | F23D 14/06 126/39 E |
| 2015/0107577 | A1 | 4/2015 | Jeong et al. | |
| 2015/0345799 | A1 | 12/2015 | Cadima et al. | |
| 2016/0178209 | A1 * | 6/2016 | Park | F24C 3/08 126/39 E |
| 2018/0135851 | A1 * | 5/2018 | Biagioli | F23D 14/04 |

* cited by examiner

*Primary Examiner* — Vivek K Shirsat
(74) *Attorney, Agent, or Firm* — Dority & Manning, P.A.

(57) ABSTRACT

A gas burner assembly includes a burner body that defines a plurality of inner flame ports at an inner sidewall of the burner body. Each inner flame port of the plurality of inner flame ports is positioned and oriented for directing a flow of fuel inwardly along a radial direction and at a swirl angle relative to the radial direction. The burner body further defines a stability chamber having a simmer flame outlet positioned at the inner sidewall of the burner body between a pair of the plurality of inner flame ports. The simmer flame outlet of the stability chamber is positioned closer to one of the pair of the plurality of inner flame ports than the other of the pair of the plurality of inner flame ports. A related cooktop appliance is also provided.

14 Claims, 5 Drawing Sheets

GAS BURNER ASSEMBLY FOR A COOKTOP APPLIANCE

FIELD OF THE INVENTION

The present subject matter relates generally to cooktop appliances and gas burner assemblies for cooktop appliances.

BACKGROUND OF THE INVENTION

Gas burners are commonly used on the cooktops of household gas cooking appliances including e.g., range ovens and cooktops built into cabinetry. A significant factor of gas burners is their ability to withstand airflow disturbances in the surroundings, such as room drafts, rapid movement of cabinet doors, and most commonly oven door manipulation. For range appliances, manipulation of the oven door can be particularly troublesome because rapid opening and closing of the oven door can produce respective under-pressure and over-pressure conditions within the oven cavity. In turn, these pressure changes may cause rapid air expansion and/or contraction in the appliances. As a result, a large amount of air passes through or around the gas burners with e.g., rapid opening or closing of the oven door(s). Similarly for built-in cooktops, pressure changes due to rapid manipulation of surrounding cabinets may result in large amounts of airflow through or around the gas burners.

Such surges of air around the gas burners, due to pressure disturbances in the surroundings, are detrimental to the flame stability of the burners and may cause extinction of the flames. This flame stability problem is particularly evident in sealed gas burner arrangements, which lack an opening in the cooktop surface around the base of the burner so as to prevent spills from entering the area beneath the cooktop.

The inherent cause of this flame instability is the low pressure drop of the fuel/air mixture passing through the flame ports of a typical burner used on the cooktop of an appliance. Although there is ample pressure available in the fuel, the pressure energy is used to accelerate the fuel to the high injection velocity required for primary air entrainment. Relatively little of this pressure is available at the flame ports. A low pressure drop across the flame ports allows pressure disturbances propagating through the ambient to easily pass through the flame ports, momentarily drawing the flame towards the burner base and leading to thermal quenching and extinction.

A solution to the above-described problem is the use of a stability chamber as described e.g., in U.S. Pat. No. 5,800,159, commonly owned by the assignee of the present disclosure. The burner is able to maintain a simmer flame at both low and high settings so that the simmer flame can relight the flame at primary flame ports when needed. However, the use of stability chambers has been limited to gas burners having a centrally located burner throat that delivers fuel to the flame ports in a radially outward fashion. Thus, inwardly fired burners, such as inverted gas burners, cannot withstand pressure disturbances as well as traditional gas burners, and are more prone to flame extinction due to pressure disturbances.

Accordingly, an inwardly fired burner with features for maintaining a simmer flame would be welcomed within the technology.

BRIEF DESCRIPTION OF THE INVENTION

The present subject matter provided a gas burner assembly. The gas burner assembly includes a burner body that defines a plurality of inner flame ports at an inner sidewall of the burner body. Each inner flame port of the plurality of inner flame ports is positioned and oriented for directing a flow of fuel inwardly along a radial direction and at a swirl angle relative to the radial direction. The burner body further defines a stability chamber having a simmer flame outlet positioned at the inner sidewall of the burner body between a pair of the plurality of inner flame ports. The simmer flame outlet of the stability chamber is positioned closer to one of the pair of the plurality of inner flame ports than the other of the pair of the plurality of inner flame ports. A related cooktop appliance is also provided. Additional aspects and advantages of the invention will be set forth in part in the following description, or may be apparent from the description, or may be learned through practice of the invention.

In a first exemplary embodiment, a gas burner assembly is provided. The gas burner assembly includes a burner body having an inner sidewall. The burner body defines a plurality of inner flame ports at the inner sidewall of the burner body. Each inner flame port of the plurality of inner flame ports is positioned and oriented for directing a flow of fuel inwardly along a radial direction and at a swirl angle relative to the radial direction. The burner body further defines a stability chamber having a simmer flame outlet positioned at the inner sidewall of the burner body between a pair of the plurality of inner flame ports. The simmer flame outlet of the stability chamber is positioned closer to one of the pair of the plurality of inner flame ports than the other of the pair of the plurality of inner flame ports.

In a second exemplary embodiment, a cooktop appliance is provided. The cooktop appliance includes a top panel. A gas burner assembly is positioned on the top panel. The gas burner assembly includes a burner body having an inner sidewall. The burner body defines a plurality of inner flame ports at the inner sidewall of the burner body. Each inner flame port of the plurality of inner flame ports is positioned and oriented for directing a flow of fuel inwardly along a radial direction and at a swirl angle relative to the radial direction. The burner body further defines a stability chamber having a simmer flame outlet positioned at the inner sidewall of the burner body between a pair of the plurality of inner flame ports along a circumferential direction. The simmer flame outlet of the stability chamber is positioned closer to one of the pair of the plurality of inner flame ports than the other of the pair of the plurality of inner flame ports along the circumferential direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
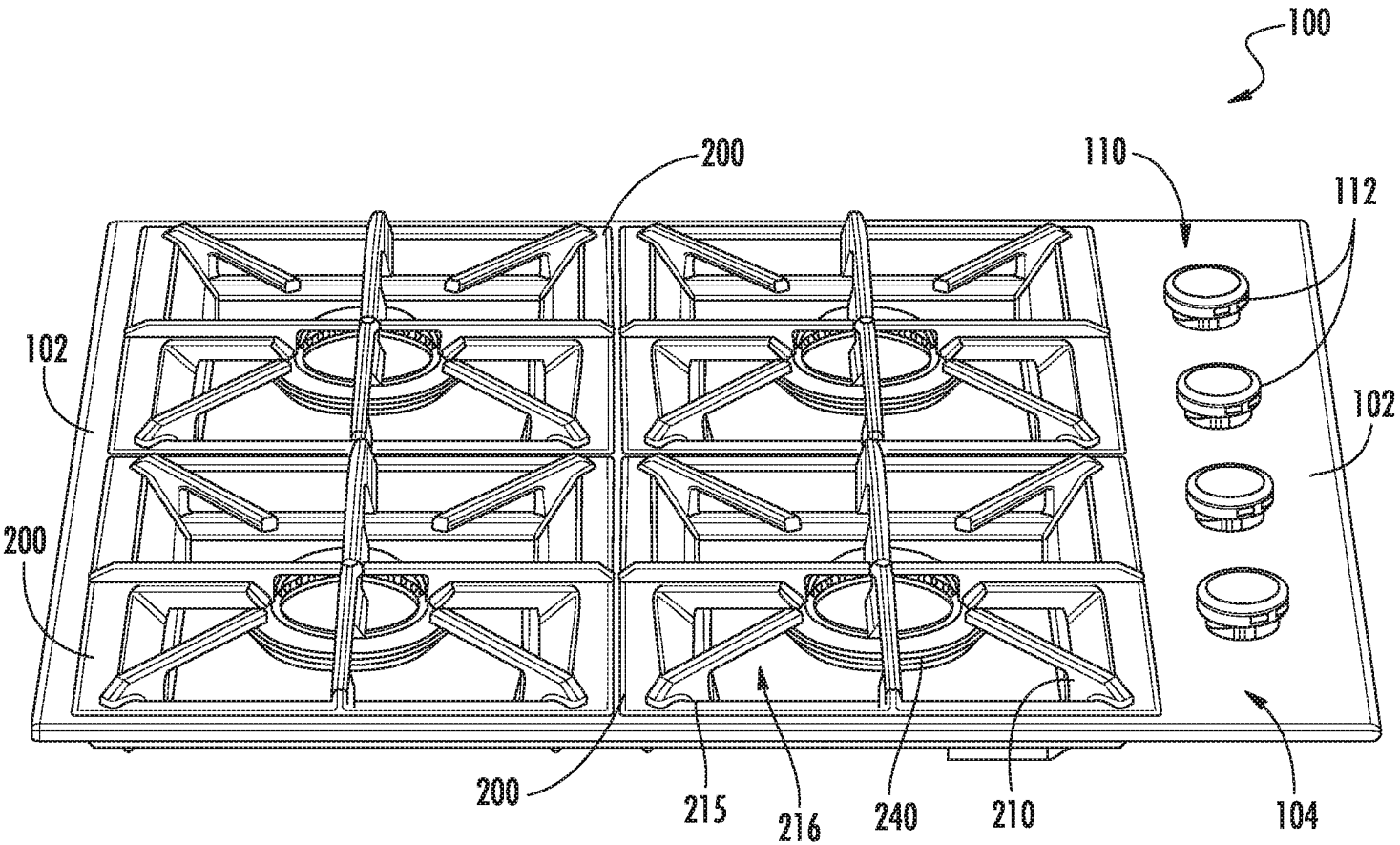
FIG. 1 provides a top, perspective view of a cooktop appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a panel 102, e.g., a top panel. By way of example, panel 102 may be constructed of enameled steel, stainless steel, glass, ceramics, and combinations thereof.

For cooktop appliance 100, a utensil holding food and/or cooking liquids (e.g., oil, water, etc.) may be placed onto gas burner assemblies 200 at a location of any of gas burner assemblies 200. Gas burner assemblies 200 can be configured in various sizes so as to provide e.g., for the receipt of cooking utensils (i.e., pots, pans, etc.) of various sizes and configurations and to provide different heat inputs for such cooking utensils. Gas burner assemblies 200 are supported on a top surface 104 of panel 102, as discussed in greater detail below. Gas burner assemblies 200 provide thermal energy to cooking utensils above panel 102 by combustion of fuel below the cooking utensils.

A user interface panel 110 is located within convenient reach of a user of cooktop appliance 100. For this exemplary embodiment, user interface panel 110 includes knobs 112 that are each associated with one of gas burner assemblies 200. Knobs 112 allow the user to activate each burner assembly and determine the amount of heat input each gas burner assembly 200 provides to a cooking utensil located thereon. User interface panel 110 may also be provided with one or more graphical display devices that deliver certain information to the user such as e.g., whether a particular burner assembly is activated and/or the level at which gas burner assembly 200 is set.

Although shown with knobs 112, it should be understood that knobs 112 and the configuration of cooktop appliance 100 shown in FIG. 1 is provided by way of example only. More specifically, user interface panel 110 may include various input components, such as one or more of a variety of touch-type controls, electrical, mechanical or electro-mechanical input devices including rotary dials, push buttons, and touch pads. User interface panel 110 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

Figure 2:
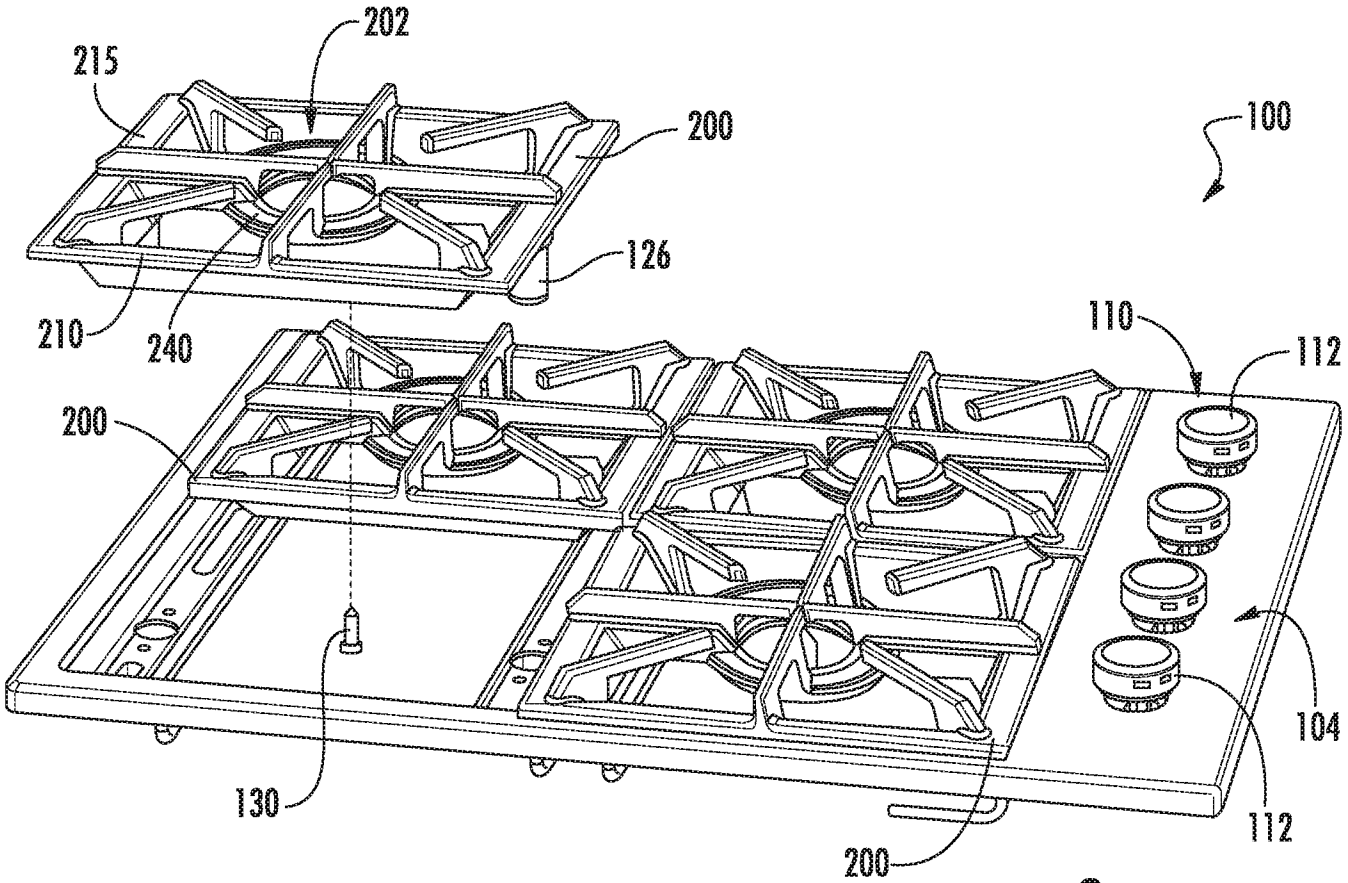
FIG. 2 provides another top, perspective view of the exemplary cooktop appliance of FIG. 1 with a gas burner assembly of the exemplary cooktop appliance shown removed from a panel of the exemplary cooktop appliance.

FIG. 2 provides another top, perspective view of cooktop appliance 100 with a gas burner assembly 200 of cooktop appliance 100 shown removed from panel 102 of cooktop appliance 100. As may be seen in FIG. 2, gas burner assembly 200 is removable from panel 102 of cooktop appliance 100. In certain exemplary embodiments, no mechanical fastening connects gas burner assembly 200 to panel 102. Thus, gas burner assembly 200 may not be fastened to panel 102, and a user may simply lift gas burner assembly 200 upwardly to remove gas burner assembly 200 from panel 102, as shown in FIG. 2. In such a manner, a top surface 104 of panel 102 below gas burner assembly 200 may be easily accessible and cleanable.

Figure 3:
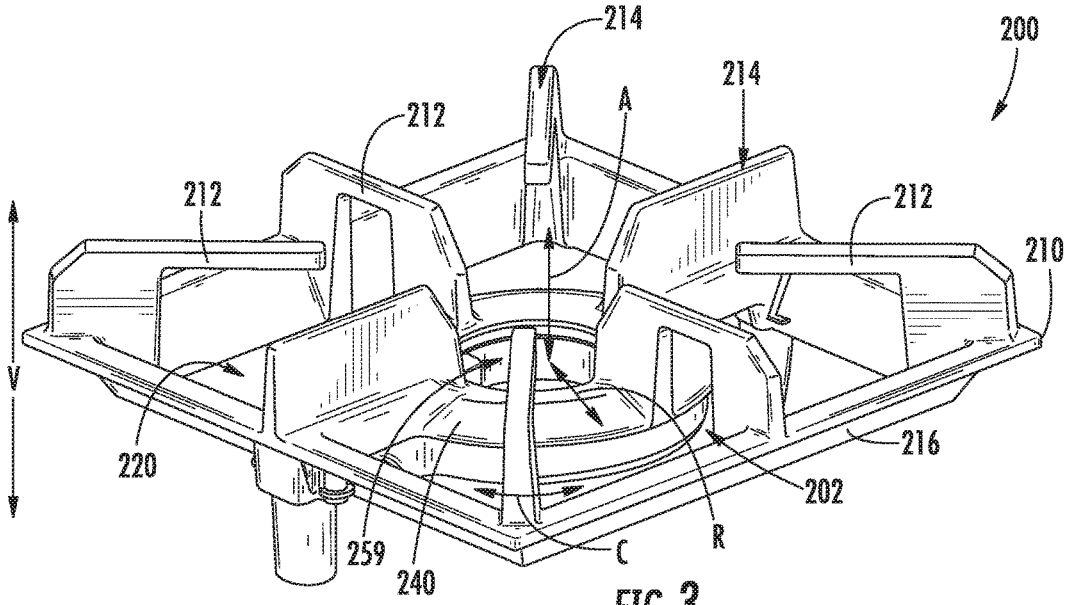
FIG. 3 provides a perspective view of a gas burner assembly according to an exemplary embodiment of the present subject matter.
Figure 4:
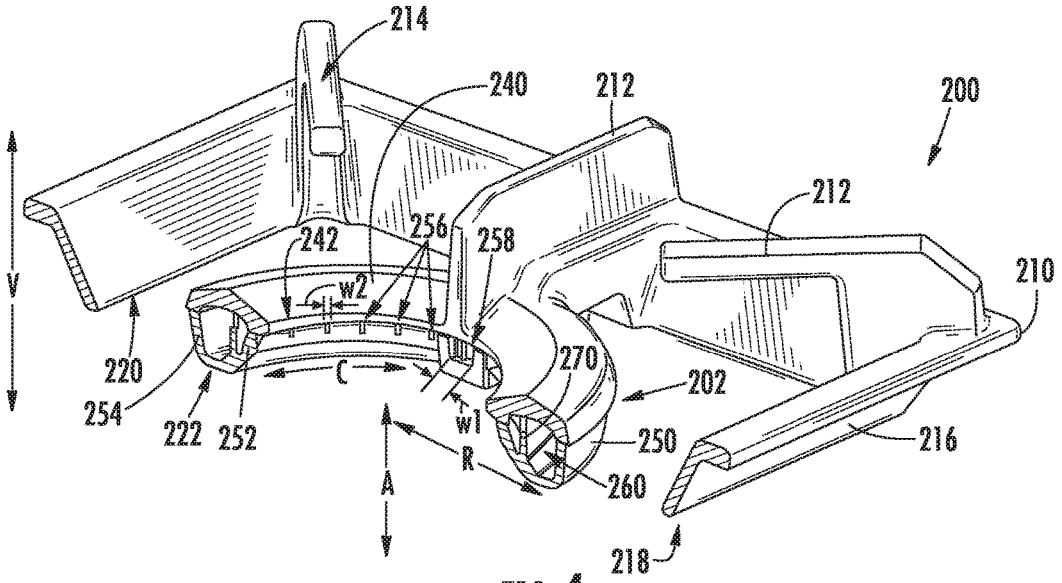
FIG. 4 provides a perspective, section view of the exemplary gas burner assembly of FIG. 3.

FIG. 3 provides a perspective view of gas burner assembly 200. FIG. 4 provides a perspective, section view of gas burner assembly 200. As shown, gas burner assembly 200 defines a vertical direction V. Gas burner assembly 200 includes a grate 210 configurable for supporting a cooking utensil, such as a pot, pan, etc. For example, grate 210 includes a plurality of tines or elongated members 212, e.g., formed of cast metal, such as cast iron. The cooking utensil may be placed on elongated members 212 of grate 210 such that the cooking utensil rests on an upper surface 214 of elongated members 212. Elongated members 212 of grate 210 may include an outer frame 216 that extends around or defines a perimeter of grate 210 and/or gas burner assembly 200. Thus, outer frame 216 may be positioned at an outer portion 218 of grate 210. Grate 210 may rest on panel 102 at outer frame 216 of grate 210. Thus, a bottom surface of outer frame 216 may rest on top surface 104 of panel 102. As shown, outer frame 216 of grate 210 may be square or rectangular in certain exemplary embodiments. Within outer frame 216, elongated members 212 may define an inner passage 220 that extends vertically through grate 210. Thus, fluid, such as air, may flow through grate 210 via inner passage 220.

Gas burner assembly 200 may also include a burner cap 240 and a burner base 250. Collectively, burner cap 240 and burner base 250 may be referred to as a burner body 202. Burner cap 240 may define an opening 242, which may be a hollow circular region within the center of burner cap 240. Burner cap 240 may be mounted to grate 210. In particular, burner cap 240 may be integrally formed with grate 210, e.g., such that grate 210 and burner cap 240 are formed of or with a common piece of metal. For example, grate 210 and burner cap 240 may be cast as a single continuous piece of metal, such as cast iron or aluminum.

Burner base 250 may be mounted to burner cap 240, e.g., with fasteners (not shown). Thus, burner cap 240 and burner base 250 may be separate pieces of metal, such as cast metal, that are mounted to each other to form a gas burner. However, according to alternative embodiments, the gas burner assembly 200 may be formed from a single piece of material or from more than two pieces of material.

Burner cap 240 and burner base 250 may be supported by grate 210 such that burner cap 240 and burner base 250 are suspended from grate 210 above panel 102 (FIG. 1). In particular, burner cap 240 and burner base 250 may be positioned over and spaced from panel 102, e.g., along the vertical direction V. Thus, spilled fluid from a cooking utensil on gas burner assembly 200 may be easily cleanable below burner body 202 and conductive heat transfer between burner body 202 and panel 102 may be limited by the vertical gap between burner body 202 and panel 102.

Figure 5:
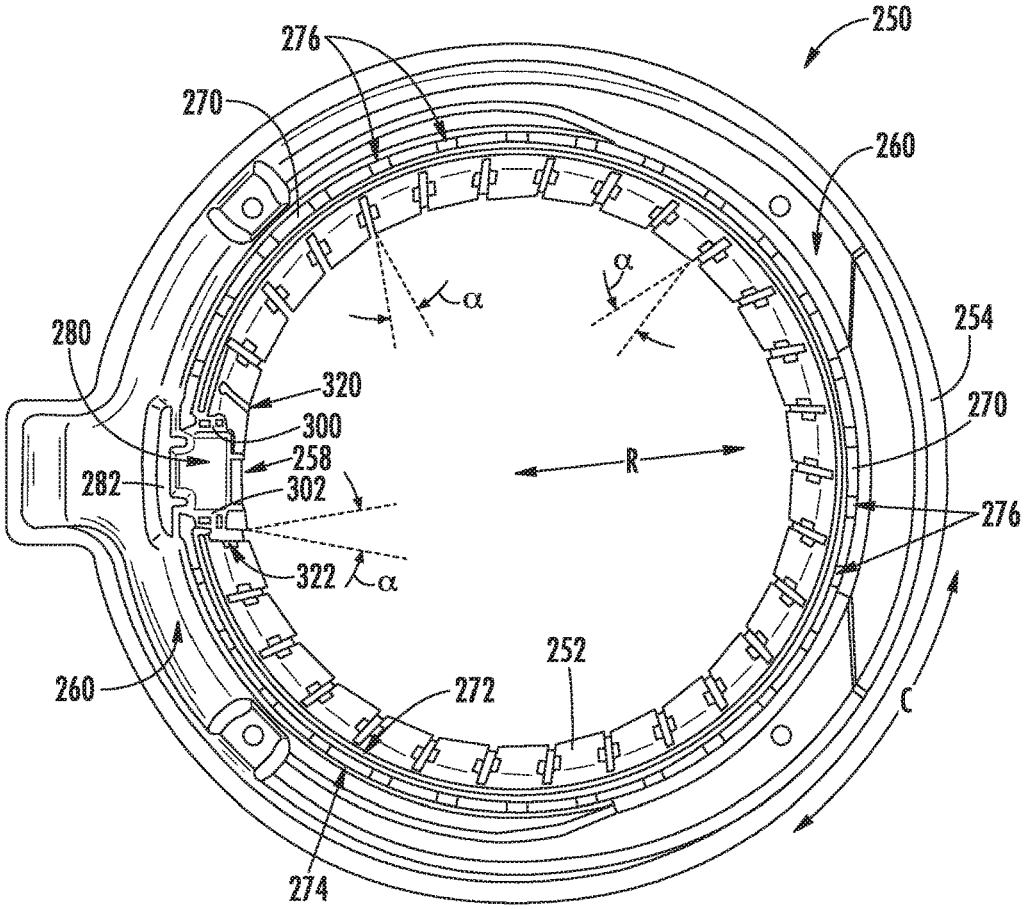
FIG. 5 provides a top, plan view of a burner base of the exemplary gas burner assembly of FIG. 3.

Burner body 202 defines a circumferential direction C, an axial direction A, and a radial direction R. Turning now to FIGS. 4 and 5, burner base 250 includes an inner sidewall 252 and an outer sidewall 254. In certain exemplary embodiments, inner sidewall 252 and/or outer sidewall 254 may be arcuate and extend along the circumferential direction C. As shown, inner sidewall 252 defines a plurality of primary or inner flame ports 256 spaced apart from one another along the circumferential direction C on inner sidewall 252. Inner sidewall 252 also defines a simmer flame port 258 (e.g., an outlet of stability chamber 280). More specifically, simmer flame port 258 may be disposed between two primary flame ports 256 along the circumferential direction C on inner sidewall 252. Outer sidewall 254 is spaced apart from inner sidewall 252 along the radial direction R such that a fuel chamber 260 is positioned between outer sidewall 254 and inner sidewall 252 along the radial direction R.

It should be understood that, in some exemplary embodiments, a bottom portion of burner base 250 may be spaced apart from burner cap 240 along the axial direction A. Thus, in some embodiments, fuel chamber 260 may be positioned between the inner and outer sidewalls 252, 254 along the radial direction R, and between the burner cap 240 and the bottom portion of the burner base 250 along the axial direction A.

As may be seen in FIG. 4, each primary flame port of primary flame ports 256 has a width W1, e.g., along a circumferential direction. Similarly, simmer flame port 258 of stability chamber 280 also having a width W2, e.g., along the circumferential direction C. The width W2 of simmer flame outlet 258 is greater than the width W1 of primary flame ports 256. Thus, fuel may flow more slowly from simmer flame port 258 than primary flame ports 256 during operation of gas burner assembly 200.

Burner base 250 defines a combustion chamber 259, which may be a hollow circular region within the center of burner base 250. Inner sidewall 252 may surround combustion chamber 259 along the circumferential direction C. As such, air may flow through combustion chamber 259 along the axial direction A, and the air may mix with a gaseous fuel/air mixture exiting primary flame ports 256 and simmer flame port 258. Gas burner assembly 200 may also include an igniter 130 (FIG. 2) positioned at or within the combustion chamber 259 to ignite the gaseous fuel/air mixture flowing into combustion chamber 259 via simmer flame port 258 and/or primary flame ports 256.

Burner base 250 may also include a baffle 270 (FIG. 4) positioned between inner sidewall 252 and outer sidewall 254 along the radial direction R within fuel chamber 260. Baffle 270 may extend between an inner surface 272 and an outer surface 274 along the radial direction R. Inner surface 272 of baffle 270 may face inner sidewall 252 along the radial direction R, and outer surface 274 of baffle 270 may face outer sidewall 254 along the radial direction R.

Baffle 270 may define a plurality of recesses 276. Recesses 276 may be spaced apart from one another along the circumferential direction C on baffle 270. Accordingly, fuel chamber 260 may extend from inner sidewall 252 to outer sidewall 254 through recesses 276 formed on baffle 270. It should be appreciated that baffle 270 may promote a uniform pressure within the burner base 250 proximate primary flame ports 256 in order to produce uniform flame lengths around inner sidewall 252.

Figure 6:
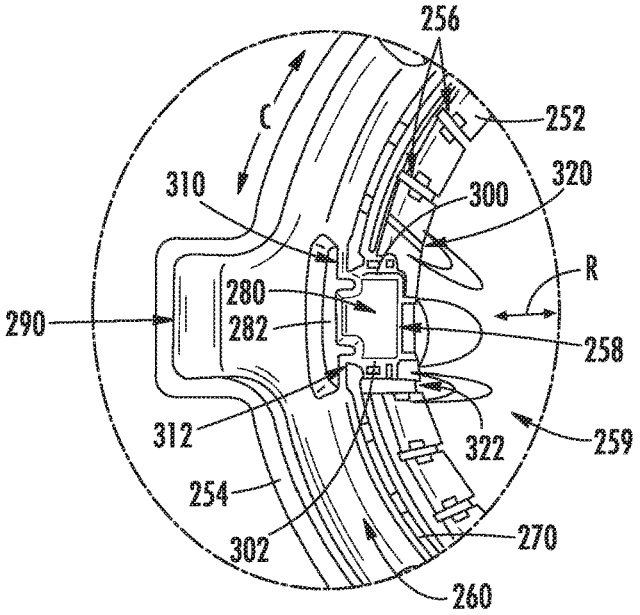
FIG. 6 provides a top, plan view of a stability chamber of the burner base of FIG. 5.

FIG. 5 provides a top, plan view of burner base 250. FIG. 6 provides a top, plan view of a stability chamber 280 of burner base 250. As shown in FIGS. 5 and 6, burner base 250 defines, at least in part, stability chamber 280. Stability chamber 280 extends outwardly from simmer flame port 258 along the radial direction R, e.g., such that stability chamber 280 extends from inner sidewall 252 into burner base 250 along the radial direction R. As shown, stability chamber 280 may be defined, at least in part, by an end wall 282 positioned within burner base 250. More specifically, end wall 282 may be positioned between inner sidewall 252 and outer sidewall 254 along the radial direction R.

Stability chamber 280 may be further defined, at least in part, by a pair of opposing walls 300, 302 positioned within burner base 250 and spaced apart from one another along the circumferential direction C. Each opposing wall 300, 302 may extend outwardly from simmer flame port 258, e.g., along the radial direction R. For example, each opposing wall 300, 302 may extend outwardly from simmer flame port 258 to end wall 282 along the radial direction R. Stability chamber 280 may be further defined between burner cap 240 and a bottom portion of burner base 250 along the axial direction A. Accordingly, in some exemplary embodiments, stability chamber 280 may be positioned between simmer flame port 258 and end wall 282 along the radial direction R, between the pair of opposing walls 300, 302 along the circumferential direction C, and between burner cap 240 and the bottom portion of burner base 250 along the axial direction A. In addition, stability chamber 280 may also be positioned adjacent to an inlet 290 of fuel chamber 260. As will be discussed below in more detail, gaseous fuel may enter fuel chamber 260 at inlet 290.

End wall 282 may, at least in part, define a first inlet port 310 and a second inlet port 312. First and second inlet ports 310, 312 may extend between fuel chamber 260 and stability chamber 280. Thus, fuel chamber 260 may be in fluid communication with stability chamber 280 via first and second inlet ports 310, 312. In an alternative embodiment, opposing wall 300 may, at least in part, define first inlet port 310, and opposing wall 302 may, at least in part, define second inlet port 312. More specifically, opposing wall 300 and end wall 282 may each define a portion of first inlet port 310, whereas opposing wall 302 and end wall 282 may each define a portion of second inlet port 312.

Primary flame ports 256 assist with combusting fuel in a swirling pattern at or within combustion chamber 259 during operation of gas burner assembly 200. For example, primary flame ports 256 may be positioned and oriented for directing fuel from fuel chamber 260 inwardly along the radial direction R into combustion chamber 259. Thus, fuel exiting primary flame ports 256 may have a radial velocity component that is directed towards a center of burner body 202 (or combustion chamber 259). Primary flame ports 256 may also be positioned and oriented for directing fuel from fuel chamber 260 as at a swirl angle $\alpha$ relative to the radial direction R. The swirl angle $\alpha$ may be defined between a central axis of each primary flame port 256 and the radial direction R, e.g., in a plane that is perpendicular to the axial direction A.

The swirl angle $\alpha$ may be selected such that fuel from primary flame ports 256 is angled away from the center of burner body 202 (or combustion chamber 259), e.g., in a swirling pattern around the center of combustion chamber 259. In certain exemplary embodiments, the swirl angle α may be no less than five degrees and no greater than thirty-five degrees. As a particular example, the swirl angle α may be about twenty degrees. As used herein, the term "about" means within five degrees of the stated angle when used in the context of swirl angles.

Simmer flame port 258 may be positioned on inner sidewall 252 in a manner that facilities operation of the simmer flame port 258 and/or stability chamber 280 while accounting for the swirl angle α of primary flame ports 256. In particular, simmer flame port 258 may be positioned between a first flame port 320 of primary flame ports 256 and a second flame port 322 of primary flame ports 256, e.g., along the circumferential direction C. Simmer flame port 258 may be directly between first and second flame ports 320, 322 such that first and second flame ports 320, 322 are immediately adjacent simmer flame port 258 and no other flame ports of primary flame ports 256 are between simmer flame port 258 and first and second flame ports 320, 322, e.g., along the circumferential direction C.

Simmer flame port 258 may be offset towards first flame port 320, e.g., along the circumferential direction C. Thus, simmer flame port 258 (e.g., a center of simmer flame port 258) may be positioned closer to first flame port 320 than to second flame port 322 (e.g., the center of simmer flame port 258) along the circumferential direction C. As an example, simmer flame port 258 may be positioned no less than two millimeters and no more than twenty millimeters closer to first flame port 320 than to second flame port 322 along the circumferential direction C. Such positioning of simmer flame port 258 relative to first and second flame ports 320, 322 may facilitate operation of simmer flame port 258 in view of the swirl angle α of first and second flame ports 320, 322. In particular, the swirl angle α of second flame port 322 may be selected such that second flame port 322 orients fuel from fuel chamber 260 towards simmer flame port 258 along the circumferential direction C during operation of gas burner assembly 200, as shown in FIG. 6. Similarly, the swirl angle α of first flame port 320 may be selected such that first flame port 320 orients fuel from fuel chamber 260 away simmer flame port 258 along the circumferential direction C during operation of gas burner assembly 200, as shown in FIG. 6. Thus, a simmer flame at simmer flame port 258 may more easily relight fuel from both first and second flame ports 320, 322 relative to simmer flame ports positioned equidistantly from first and second flame ports 320, 322. In addition, such positioning of simmer flame port 258 relative to first and second flame ports 320, 322 may reduce coalescence between the simmer flame at simmer flame port 258 and a flame at first flame port 320, e.g., during high fuel flow rates from primary flame ports 256.

Figure 7:
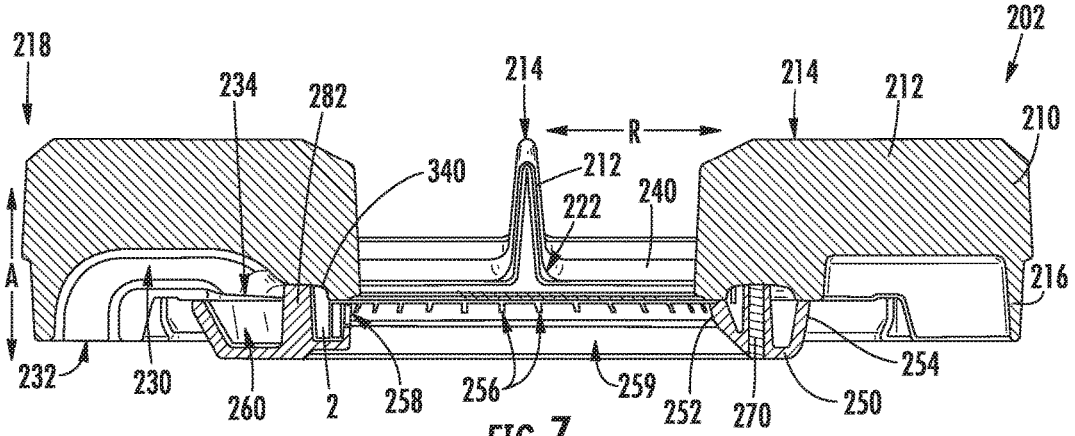
FIG. 7 provides a side, section view of the exemplary gas burner assembly of FIG. 3.

Referring now to FIG. 7, grate 210 includes features for supplying fuel to burner body 202, e.g., to fuel chamber 260. Grate 210 defines an internal fuel passage 230, e.g., configured for directing fuel through grate 210 to burner base 250. It should be appreciated that grate 210 may be constructed of or with any suitable material. For example, grate 210 may be constructed of or with a single piece of cast metal. In particular, grate 210 may be formed of cast iron with the internal fuel passage 230 formed within grate 210 using disposable cores during the casting process.

Internal fuel passage 230 extends between an inlet 232 and an outlet 234. Inlet 232 is positioned at or adjacent outer portion 218 of grate 210. Conversely, outlet 234 is positioned at or adjacent central portion 222 of grate 210. Thus, internal fuel passage 230 may extend between outer portion 218 and central portion 222 of grate 210 within one of elongated members 212 of grate 210. In addition, at least a portion of internal fuel passage 230 may be positioned above (e.g. higher along the vertical direction V that is parallel to the axial direction A) simmer flame port 258 and/or each primary flame port 256. Alternatively, or in addition to, internal fuel passage 230 may be positioned adjacent stability chamber 280.

Outlet 234 is contiguous with, or adjacent to, fuel chamber 260. More specifically, outlet 234 of internal fuel passage 230 is positioned above inlet 290 of fuel chamber 260 along the vertical direction V. Thus, fuel from internal fuel passage 230 may flow into fuel chamber 260 via outlet 234. Fuel may then exit fuel chamber 260 at primary flame ports 256. Fuel may also exit the fuel chamber 260 at the first and second inlet ports 310, 312 and subsequently enter stability chamber 280 where the fuel flows to simmer flame port 258.

Figure 8:
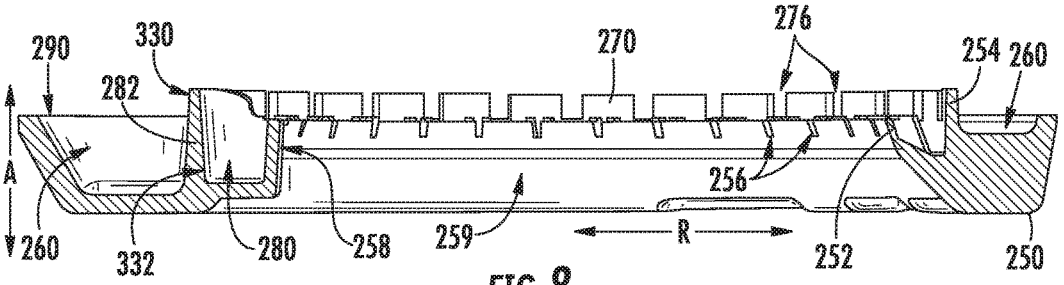
FIG. 8 provides a side, section view of the burner base of FIG. 5.
Figure 9:
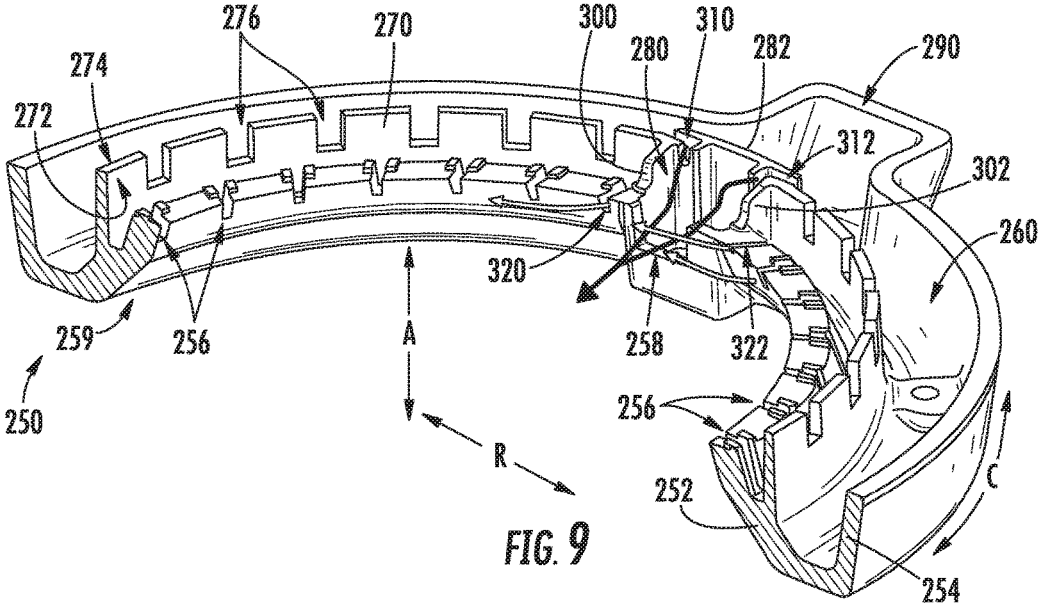
FIG. 9 provides a perspective, section view of the burner base of FIG. 5.

FIG. 8 provides a side, section view of burner base 250. FIG. 9 provides a perspective, section view of burner base 250. As shown in FIG. 8, stability chamber 280 extends between a top portion 330 and a bottom portion 332, e.g., along an axial direction A. First and second inlet ports 310, 312 may be positioned at or adjacent top portion 330 of stability chamber 280. For example, first and second inlet ports 310, 312 may also be positioned above simmer flame port 258 along the axial direction A. Thus, simmer flame port 258 may be positioned between first and second inlet ports 310, 312 and bottom portion 332 of stability chamber 280 along the axial direction A.

As shown in FIGS. 7 and 9, a top wall 340 of burner body 202 (e.g., burner cap 240) at top portion 330 of stability chamber 280 may slope downwardly along the radial direction R between first and second inlet ports 310, 312 and simmer flame port 258. Such sloping of top wall 340 may induce a downward (e.g., along the vertical direction V) velocity component to fuel exiting stability chamber 280 at simmer flame port 258 during operation of gas burner assembly 200, as shown in FIG. 9 with the solid black arrows at simmer flame port 258. The downward velocity component of fuel from stability chamber 280 may reduce coalescence between the simmer flame at simmer flame port 258 and a flame at first flame port 320, e.g., during high fuel flow rates from primary flame ports 256.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly, comprising:

a burner body having an inner sidewall, the burner body defining a plurality of inner flame ports at the inner sidewall of the burner body, each inner flame port of the plurality of inner flame ports positioned and oriented for directing a flow of fuel inwardly and at a swirl angle relative to a radial direction, wherein the burner body further defines a stability chamber having a simmer flame outlet positioned at the inner sidewall of the burner body between an adjacent pair of the plurality of inner flame ports, the adjacent pair of the plurality of inner flame ports positioned adjacent the simmer flame outlet of the stability chamber, the simmer flame outlet of the stability chamber positioned closer to one of the adjacent pair of the plurality of inner flame ports than the other of the adjacent pair of the plurality of inner flame ports, the stability chamber at least partially defined by an end wall positioned within the burner body, the end wall positioned opposite the simmer flame outlet about the stability chamber along the radial direction, wherein the burner body defines a fuel chamber within the burner body, the plurality of inner flame ports being contiguous with the fuel chamber, the stability chamber extending between a top portion and a bottom portion along an axial direction, the stability chamber having a plurality of inlet ports positioned at the top portion of the stability chamber, the plurality of inlet ports contiguous, with the fuel chamber, wherein a top wall of the burner body at the stability chamber slopes downwardly along the radial direction between the plurality of inlet ports and the simmer flame outlet of the stability chamber, and wherein the top wall of the burner body at the stability chamber slopes downwardly along the radial direction such that fuel exiting the stability chamber at the simmer flame outlet of the stability chamber has a downward velocity component during operation of the gas burner assembly.

2. The gas burner assembly of claim 1, wherein the swirl angle of the other of the adjacent pair of the plurality of inner flame ports orients fuel flow towards the simmer flame outlet of the stability chamber during operation of the gas burner assembly.

3. The gas burner assembly of claim 2, wherein the swirl angle of the one of the adjacent pair of the plurality of inner flame ports orients fuel flow away from the simmer flame outlet of the stability chamber during operation of the gas burner assembly.

4. The gas burner assembly of claim 1, wherein each inner flame port of the plurality of inner flame ports has a width along a circumferential direction, the simmer flame outlet of the stability chamber also having a width along the circumferential direction, the width of the simmer flame outlet of the stability chamber being greater than the width of each inner flame port of the plurality of inner flame ports.

5. The gas burner assembly of claim 1, wherein the inlet ports of the plurality of inlet ports are positioned above the simmer flame outlet of the stability chamber along the axial direction.

6. The gas burner assembly of claim 1, further comprising a grate, a supply conduit formed within the grate such that the supply conduit extents through the grate to the fuel chamber of the burner body, a top surface of the grate configured for supporting a cooking utensil.

7. The gas burner assembly of claim 1, wherein the burner body has a baffle disposed within the fuel chamber such that the baffle divides the fuel chamber into a first fuel chamber portion and a second fuel chamber portion, the first fuel chamber portion contiguous with an inlet of the fuel chamber, the second fuel chamber portion contiguous with the plurality of inner flame ports.

8. A cooktop appliance, comprising:

a top panel; and a gas burner assembly positioned on the top panel, the gas burner assembly comprising a burner body having an inner sidewall and an outer sidewall, the outer sidewall of the burner body extending around the inner sidewall of the burner body along a circumferential direction, the burner body defining a plurality of inner flame ports at the inner sidewall of the burner body, each inner flame port of the plurality of inner flame ports positioned and oriented for directing a flow of fuel inwardly along a radial direction and at a swirl angle relative to the radial direction, wherein the burner body further defines a stability chamber having a simmer flame outlet positioned at the inner sidewall of the burner body between an adjacent pair of the plurality of inner flame ports along a circumferential direction, the adjacent pair of the plurality of inner flame ports positioned adjacent the simmer flame outlet of the stability chamber, the simmer flame outlet of the stability chamber positioned closer to one of the adjacent pair of the plurality of inner flame ports than the other of the adjacent pair of the plurality of inner flame ports along the circumferential direction, the stability chamber formed within burner body such that the stability chamber is spaced from the outer sidewall of the burner body along the radial direction, wherein the burner body defines a fuel chamber within the burner body, the plurality of inner flame ports being contiguous with the fuel chamber, the stability chamber extending between a top portion and a bottom portion along an axial direction, the stability chamber having a plurality of inlet ports positioned at the top portion of the stability chamber, the plurality of inlet ports contiguous with the fuel chamber, wherein a top wall of the burner body at the stability chamber slopes downwardly along the radial direction between the plurality of inlet ports and the simmer flame outlet of the stability chamber, and wherein the top wall of the burner body at the stability chamber slopes downwardly along the radial direction such that fuel exiting the stability chamber at the simmer flame outlet of the stability chamber has a downward velocity component during operation of the gas burner assembly.

9. The cooktop appliance of claim 8, wherein the swirl angle of the other of the adjacent pair of the plurality of inner flame ports orients fuel flow towards the simmer flame outlet of the stability chamber during operation of the gas burner assembly.

10. The cooktop appliance of claim 9, wherein the swirl angle of the one of the adjacent pair of the plurality of inner flame ports orients fuel flow away from the simmer flame outlet of the stability chamber during operation of the gas burner assembly.

11. The cooktop appliance of claim 8, wherein each inner flame port of the plurality of inner flame ports has a width along a circumferential direction, the simmer flame outlet of the stability chamber also having a width along the circumferential direction, the width of the simmer flame outlet of the stability chamber being greater than the width of each inner flame port of the plurality of inner flame ports.

12. The cooktop appliance of claim 8, wherein the inlet ports of the plurality of inlet ports are positioned above the simmer flame outlet of the stability chamber along the axial direction.

13. The cooktop appliance of claim 8, further comprising a grate, a supply conduit formed within the grate such that the supply conduit extents through the grate to the fuel chamber of the burner body, a top surface of the grate configured for supporting a cooking utensil.

14. The cooktop appliance of claim 8, wherein the burner body has a baffle disposed within the fuel chamber such that the baffle divides the fuel chamber into a first fuel chamber portion and a second fuel chamber portion, the first fuel chamber portion contiguous with an inlet of the fuel chamber, the second fuel chamber portion contiguous with the plurality of inner flame ports.

* * * * *